US006236816B1

(12) United States Patent
Warbus et al.

(10) Patent No.: US 6,236,816 B1
(45) Date of Patent: May 22, 2001

(54) PRINTING OR DUPLICATING APPARATUS OPTIONALLY OPERATING WITH MAGNETIC OR NON MAGNETIC TONER

(75) Inventors: Volker Warbus, Oberhaching; Karola Scheidig, Neufinsing; Albrecht Gerstner, Oberbergkirchen, all of (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/254,292

(22) PCT Filed: Nov. 6, 1997

(86) PCT No.: PCT/EP97/06163

§ 371 Date: Jan. 3, 2000

§ 102(e) Date: Jan. 3, 2000

(87) PCT Pub. No.: WO99/24877

PCT Pub. Date: May 20, 1999

(51) Int. Cl.[7] ..... G03G 15/06; G03G 21/00

(52) U.S. Cl. ..... 399/46; 399/53; 399/81; 399/82

(58) Field of Search ..... 399/46, 38, 119, 399/120, 53, 81, 82

(56) References Cited

U.S. PATENT DOCUMENTS

| | | | | |
|---|---|---|---|---|
| 4,097,139 | | 6/1978 | Hauser et al. . | |
| 4,615,608 | | 10/1986 | Mizutani . | |
| 4,942,429 | * | 7/1990 | Katitani . | |
| 5,036,362 | | 7/1991 | Stelter . | |
| 5,282,001 | * | 1/1994 | Watson . | |
| 5,410,388 | * | 4/1995 | Pacer et al. . | |
| 5,546,178 | | 8/1996 | Manzer et al. . | |
| 5,905,925 | * | 5/1999 | Kawabata et al. | 399/45 |

FOREIGN PATENT DOCUMENTS 0 357 086 3/1990 (EP) .

OTHER PUBLICATIONS

Japanese Abstract, 07333998, Dec. 22, 1995.

* cited by examiner

*Primary Examiner*—Richard Moses
(74) *Attorney, Agent, or Firm*—Schiff Hardin & Waite

(57) ABSTRACT

A printer or copier apparatus is fashioned in such a way that with a single apparatus a recording medium can be printed both with magnetically readable toner (MICR toner) and also with standard toner. For this purpose, it contains one or more correspondingly fashioned developer stations (ES) and a control unit for the adaptation of the print process parameters dependent on the mode of operation.

20 Claims, 4 Drawing Sheets

PRINTING OR DUPLICATING APPARATUS OPTIONALLY OPERATING WITH MAGNETIC OR NON MAGNETIC TONER

BACKGROUND OF THE INVENTION

Field of the Invention

The present invention relates to a printer or copier apparatus for the printing of a recording medium with magnetically readable toner or toner which is not readable magnetically, in a single apparatus.

In particular, in the USA, it is standard to print checks or financial documents with magnetically readable toner, so that the documents can be read using the MICR (magnetic ink character recognition) method. Magnetically readable toner, called MICR toner, generally contains ferromagnetic particles (such as soft magnetic particles) with a narrow hysteresis loop made of pure iron or other magnetizable materials such as ferrites, iron oxide or magnetite.

Thus, for a wide variety of applications MICR developer mixtures are used that contain as components e.g. 90–99% iron powder, 2–3.5% resin (styrene/acrylic copolymer resin), 0.7–1.4% polymers (styrene/acrylatic copolymer), and 10–20% iron oxide, or e.g. MICR toner with 30–50% styrene/acrylic copolymer resin, 10–20% styrene/acrylate copolymer, 10–30% iron oxide, 3–7% 1-propene polymer, 3–7% epoxy resin, 1–3% lithium stearate and 0.5–2% tetraalkyl ammonium compound. For the black tinting (carbon black), e.g. 0.1–1% artificial pigments (polyvinylidene fluoride) can be contained.

In the following, the term "magnetic" toner is used for an MICR-capable magnetically readable toner. The term "non-magnetic" toner designates a toner which is not readable magnetically, e.g. a standard toner.

For processing in an electrographic printer, the complex composition of MICR developer mixture or, respectively, toner requires particular adaptation to the aggregates involved in the print process, such as for example the developer station, the transfer printing station, the photoconductor, and the fixing station. Among other things, for this reason it has previously been regarded as necessary to use separate printers for printing with MICR toner. These printers are designed exclusively for the processing of MICR toner, with which a processing of standard toners which are not readable magnetically is not possible. For the handling of mixed jobs, two printers have thus been used, namely an MICR-capable printer and a standard printer, or else an MICR-capable printer was used exclusively for the printing. Both methods are uneconomical and require considerable expense.

It is known from U.S. Pat. No. 4,097,139 to provide a copier apparatus with an exchangeable developer station, in order to enable processing of toner with various colors, but variously colored toners of this sort have a chemical composition that is nearly identical and differ only in the pigment color. No adaptation of the processing method is required for the exchange.

SUMMARY OF THE INVENTION

An object of the invention is thus to provide a printer or copying apparatus with which printing with magnetically readable toner, called MICR toner, and with toner which is not readable magnetically is possible with the same apparatus.

This and other objects are achieved by a multifunctional printer or copier apparatus with a means for printing a recording medium with magnetic toner in a first mode of operation or with non-magnetic toner in a second mode of operation in a single apparatus, including

- a reception means arranged in the apparatus for the alternative, exchangeable reception of a developer station containing magnetic or non-magnetic toner, for the production of toner images on a photoconductor,
- a transfer printing station for the transfer printing of the toner images on the recording medium,
- an operational control unit that determines the mode of operation dependent on the developer station located in the reception means, and
- a process control unit connected functionally with the operational control unit, which process control unit determines setting values of the process parameters of sub-aggregates involved in the print process, dependent on the set mode of operation.

The invention also relates to a multifunctional printer or copier apparatus with a means for printing a recording medium with magnetic toner in a first mode of operation or with non-magnetic toner in a second mode of operation in a single apparatus, including

- at least one developer station that processes magnetic toner, and at least one developer station that processes non-magnetic toner, which are fashioned for the production of toner images as individually switchable developer stations, and are arranged along a photoconductor,
- a transfer printing station for the transfer printing of the toner images on the recording medium,
- an operational control unit that determines the mode of operation, and
- a process control unit that is functionally connected with the operational control unit, which process control unit determines setting values of the process parameters of sub-aggregates involved in the print process, dependent on the set mode of operation.

As another development of the invention, a multifunctional printer or copier apparatus is provided with a means for printing a recording medium with magnetic toner in a first mode of operation or with non-magnetic toner in a second mode of operation in a single apparatus, including

- at least one developer station that accepts magnetic or non-magnetic toner for the production of toner images on a photoconductor,
- a supply means for the alternative supplying of magnetic or non-magnetic toner to the developer station dependent on the mode of operation,
- a transfer printing station for the transfer printing of the toner images on the recording medium,
- an operational control unit that determines the mode of operation, and
- a process control unit that is functionally connected with the operational control unit, which process control unit determines setting values of the process parameters of sub-aggregates involved in the print process, dependent on the set mode of operation.

As yet a further development, the multifunctional printer or copier apparatus with a means for printing a recording medium with magnetic toner in a first mode of operation or with non-magnetic toner in the second mode of operation in a single apparatus, includes

- a developer station with at least one developer chamber containing magnetic toner and at least one developer chamber containing non-magnetic toner, which are fashioned as individually switchable developer chambers for the production of toner images on one or more photoconductor regions, a transfer printing station for the transfer printing of the toner images on the recording medium, an operational control unit that determines the mode of operation, and a process control unit that is functionally connected with the operational control unit, which process control unit determines setting values of the process parameters of sub-aggregates involved in the print process, dependent on the set mode of operation.

Advantageous embodiments of the invention are provide that the region of the transfer printing station of at least two recording medium webs are guided next to one another, and a developer chamber is allocated to each of the recording medium webs. An operator panel may be included having an input means and/or a display means for operating data, including the modes of operation, which operator panel is functionally connected with the operational control unit.

An identification arrangement for the identification of the developer station may be provided. An identifier element allocated to the developer station, and having a scanning means for the identifier element, which scanner means is allocated to the apparatus and is functionally connected with the control units. The identification arrangement comprises a non-volatile memory allocated to the developer station for the storage of operational data, as well as a communication interface for the detachable functional connection of the non-volatile memory with the control units.

Optionally, the setting values of the process parameters to be set dependent on the modes of operation are stored in a memory in the form of tables that can be called.

A blocking means may be provided for the selective blocking of operating functions. The blocking means includes a memory for the modifiable reception of data characterizing the blocked mode of operation, and a testing means, which, given the calling of a mode of operation, checks whether a blocked mode of operation is present, based on the data stored in the memory, and which blocks print operation given the presence of a blocked mode of operation.

As a further option, a counting means for the acquisition of the print volume produced in the individual operational modes may be provided.

All the solutions have in common the possibility of selection between a mode of operation in which printing takes place with magnetic toner and a mode of operation in which printing takes place with non-magnetic toner. The mode of operation is thereby selected or, respectively, determined via an operation control unit. A process control unit is functionally connected with the operation control unit, which process control unit determines, dependent on the selected mode of operation, the setting values of the process parameters of sub-aggregates involved in the print process, such as for example the photoconductor drum, the developer station, the transfer printing station, and the fixing station. The setting values of the process parameters can thereby be: the bias voltage between the developer station and the photoconductor, the charging of the photoconductor, the corotron voltage, or, respectively, the intermediate illumination in the region of the transfer printing station, and the fixing temperature in the fixing station. These setting values are adapted dependent on the mode of operation. Via an operator panel, the calling of the mode of operation takes place either automatically or manually.

In a first solution, the apparatus contains an exchangeable developer station, in a second solution it contains two stationary switchable developer stations, in a third solution it contains a developer station to which corresponding toner is supplied according to the mode of operation, and in a fourth solution it contains a developer station with several individual switchable developer chambers.

The inventive solutions enable printing with magnetic and non-magnetic toner with only one multi-functional apparatus. This enables a flexible and economical use of equipment, with the possibility of rapid adaptation to the current task.

In an advantageous embodiment of the invention, an active identification arrangement is allocated to the developer station, in which arrangement all functionally relevant operating states of the developer station are stored in such a way that they can be called. These states are for example the elapsed operating time, the type of toner contained in the device, the operating parameters to be set during use with the associated setting values, the production identifier including the part number, the history and the number of pages printed in the various modes of operation. Among other things, this enables an automatic adaptation of the apparatus to the type of toner used and an exact tracking of disturbances in operation, which is of considerable advantage in case of service and in subsequent analyses. In addition, e.g. for purposes of billing for use of leased printing equipment, an exact determination of the materials consumed can be obtained.

In a further advantageous embodiment, operational reliability is increased in that the apparatus contains a blocking means for the selective blocking of individual modes of operation or, respectively, functions. It can thereby for example be ensured that printing with magnetic toner takes place only if the user is authorized and the apparatus has been enabled therefor.

BRIEF DESCRIPTION OF THE DRAWINGS

Embodiments of the invention are shown in the drawings and are explained in more detail in the following in relation to examples.

DETAILED DESCRIPTION OF THE PREFERRED EMBODIMENTS

Figure 1:
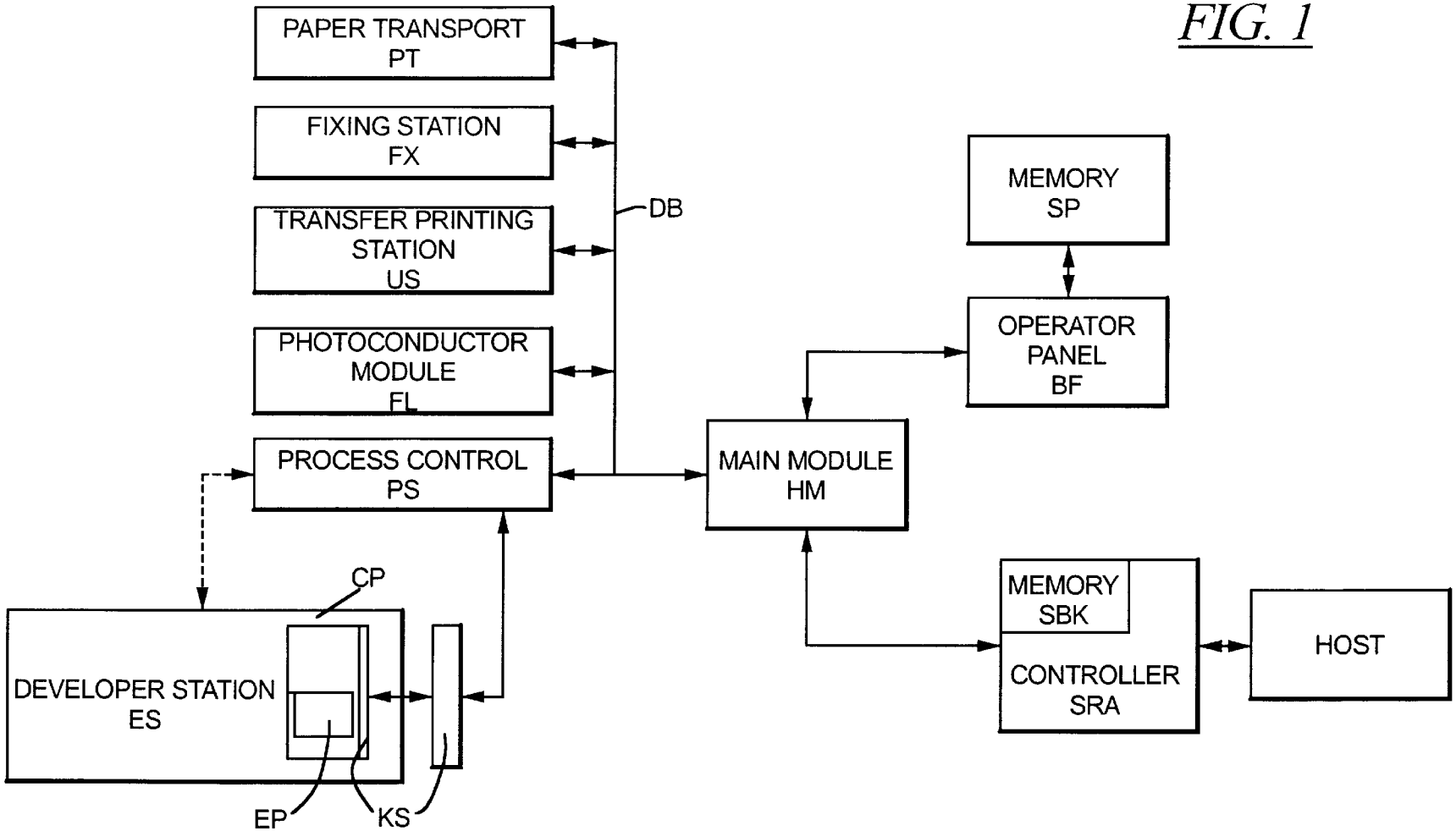
FIG. 1 shows a schematic block diagram of a multi-functional electrographic printer apparatus for optional operation with magnetic or non-magnetic toner.

The structural design of an electrographic printer for optional operation with magnetic or non-magnetic toner is shown in FIG. 1. It contains the sub-systems that are necessary for the electrophotographic print process and are described in more detail for example in U.S. Pat. No. 5,546,178. Essentially, these are: a photoconductor module FL for the production of latent charge images on a photoconductor drum, whereby with the aid of a charge means the photoconductor drum is first charged and then illuminated via an LED character generator or a laser; a developer station ES for the tinting of the latent charge images with toner, whereby toner images arise; a transfer printing station US for the transfer printing of the toner images on recording media, e.g. paper, with the aid of a transfer printing corotron; a fixing station FX, in which, by means of pressure and heat or by means of flash fixing, the loose toner images are fixed on the recording medium, and a paper transport system PT for transporting the recording medium through the apparatus.

Figure 2:
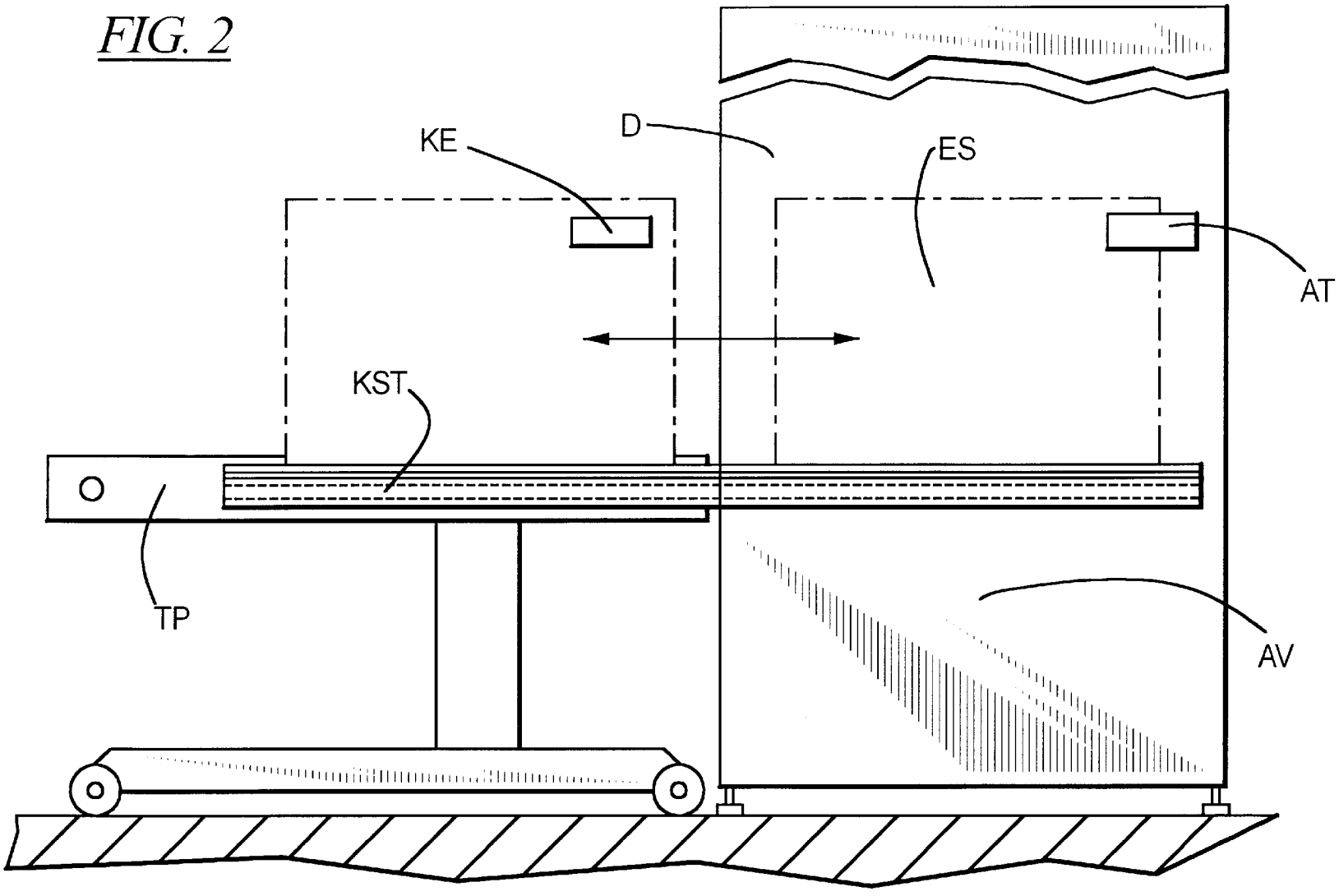
FIG. 2 shows a schematic view of a printer apparatus with a reception means for the alternative, exchangeable reception of a developer station containing a magnetic or non-magnetic toner.

So that the recording medium can optionally be printed with magnetic or non-magnetic toner using the same apparatus, corresponding to the view in FIG. 2 the developer station ES is exchangeably mounted in a reception means AV of the apparatus D. The reception means thereby contains rails or mounting elements KST, which work together with corresponding mounts of the developer station housing and which enable the developer station ES to be withdrawn from the apparatus housing along the rails and to be stored on a transport table TP. Subsequently, another developer station can be pushed in. According to the mode of operation desired, in this way a developer station containing a magnetic toner or a developer station containing a non-magnetic toner is arranged in the apparatus.

All the sub-systems are connected with an apparatus control unit via a data bus DB. The apparatus control unit is of modular construction, and contains a main module HM which is controlled via microprocessors, which controls the other modules of the apparatus control unit according to the master-slave principle as an operational control. A microprocessor-controlled process control unit PS in the form of a sub-module is coupled with the main module HM via the data bus DB, which process control unit in particular controls the electrophotographic process, and, among other things, determines the setting values of the process parameters of the sub-systems involved in the print process dependent on the type of operation (printing with magnetic or with non-magnetic toner). These process parameters are for example the bias voltage in the developer station ES between the developer station and the photoconductor drum, the charging of the photoconductor drum and the fixing temperature in the fixing station. For explanation in more detail of the process parameters and the function of an apparatus control unit in general, reference is made to U.S. Pat. No. 5,124,732.

According to whether printing takes place with magnetic or with non-magnetic toner, these setting values are different and must be set correspondingly. For example, given printing with magnetic toner the following setting values are used: bias voltage 235 V, charge voltage at the photoconductor drum 480 V, fixing temperature maximal (>210° Celsius) and deactivation of the intermediate illumination. Given printing with a non-magnetic standard toner, the corresponding setting values are: bias voltage 200 V, charge voltage at the photoconductor drum 520 V, fixing temperature maximal (<2000 Celsius [sic]), and intermediate illumination in the transfer station activated.

In addition, the apparatus control unit contains an operator panel BF connected with the main module HM via a data bus, which panel is fashioned as a microprocessor-controlled personal computer operator panel, and comprises an input display screen (such as a touch screen) as an input and display means for the operational data or, respectively, the setting values of the process parameters. In turn, the operator panel BF is connected with a memory SP via a data bus, in which memory the setting values of the process parameters to be set dependent on the mode of operation are stored in the form of tables that can be called up.

For the processing and preparation of the print data supplied from an external data source Host, the apparatus comprises a controller SRA, whose design and function are specified in more detail for example in U.S. Pat. No. 5,124,732. It can comprise a scalable raster architecture. The controller SRA is coupled in a standard way, via a data bus, with the apparatus control unit, and thereby with the main module HM.

In order to enable automatic identification in particular of the developer station and thereby the toner contained therein or, respectively, processed with the developer station, the apparatus control unit can comprise an identification arrangement.

In the exemplary embodiment shown in FIG. 2, this consists of an identifier element KE attached to the housing of the developer station, e.g. in the form of a barcode, and a scanning means AT allocated to the receiver means for the developer station in the apparatus, which scanning means can be fashioned in the form of an optical scanning means. When the developer station ES is inserted, the scanner AT scans the identifier element KE and supplies the identifier data to the process control unit PS for further processing. The type of developer station is then displayed in the operator panel BF. In addition, the acquired data can be used to select automatically the process parameters to be set, or, respectively, to set the corresponding setting values.

In the embodiment shown in FIG. 1, the identification arrangement contains a microprocessor-controlled chip CP, arranged on the developer station, with a non-volatile memory EP (EEPROM) for the storing of operational data of the developer station, as well as a communication interface KS for the erasable functional connection of the microprocessor-controlled chip CP with the process control unit PS. The communication interface KS can contain a standard data interface with a CAN bus. In the assembled state of the developer station, the process control unit PS communicates with the microprocessor-controlled chip CP by calling operational data from the memory EP or updating these data in the memory EP.

In the non-volatile memory EP, all functionally relevant operating states of the developer station can be stored so as to be able to be called and updated. These include e.g. the elapsed operating time, the type of toner contained in the printer, the operational parameters to be set during use with the associated setting values, the production identifier including part number, the history and the number of pages printed in the various operating modes. Among other things, this enables an automatic adaptation of the apparatus to the type of toner used and an exact tracking of operational disturbances, which is of considerable advantage in case of service and in subsequent analyses. In addition, an exact acquisition of materials consumed is possible, e.g. for purposes of billing for use of leased equipment.

The data can be called up via the operator panel BF, inputted and displayed, or else they are automatically acquired via the process control unit PS and stored in the memory EP or updated there.

In order to enable selective blocking of individual operational modes, the apparatus can comprise a blocking means in the context of the apparatus control unit. For this purpose, corresponding to the view in FIG. 1, the controller SRA contains a memory region SBK for the reception of the data characterizing the blocked mode of operation, e.g. in the form of a data word. The input of the data word, e.g. via the operator panel BF, can be secured, so that entry is possible only by authorized persons. By means of comparison of the data stored in the memory region SBK with the data from the operator panel BF characterizing the mode of operation called, given calling of a mode of operation (e.g., upon commissioning of the apparatus), a testing means, in this case the main module HM, checks whether a blocked mode of operation is present, and, if a blocked mode of operation is present, blocks print operation. This blocking state is then displayed in the operator panel BF. It can thereby for example be ensured that printing with magnetic toner can take place only if the user is authorized and the apparatus has been enabled therefor.

Concerning the detailed functioning of the apparatus control unit:

If the developer station does not comprise an identifier element, or if no identification arrangement is provided, the operator calls the allocated mode of operation via the operator panel BF, after insertion of the corresponding developer station ES for operation with magnetic or non-magnetic toner into the reception means AV of the apparatus. Given calling of operation with magnetic toner, the main module HM, as part of the operational control unit, checks the authorization on the basis of the content of the memory region SBK of the controller SRA. After determining the mode of operation via the operational control unit, the main module HM calls the setting values allocated to the mode of operation from the table memory SP of the operator panel BF, and communicates it to the sub-system of the apparatus via the process control unit PS. A message to the external data source (Host) subsequently takes place via the controller SRA, and print operation is enabled.

If an identification arrangement is provided for the developer station, after the insertion of the developer station ES into the apparatus, the data scanned or stored in the memory EP is transmitted to the process control unit PS. This unit signals the data to the main module HM and from there further signals them to the operator panel BF. Given provision of operation with magnetic toner, the operation control unit with the main module HM and operator panel BF checks the authorization on the basis of the content of the memory region SBK of the controller SRA. After the determination of the mode of operation via the operational control unit, the main module HM calls the setting values allocated to the mode of operation from the table memory SP of the operator panel BF, and transmits them to the sub-systems of the apparatus via the process control unit PS. A message to the external data source Host subsequently takes place via the controller SRA, and print operation is enabled.

Figure 3:
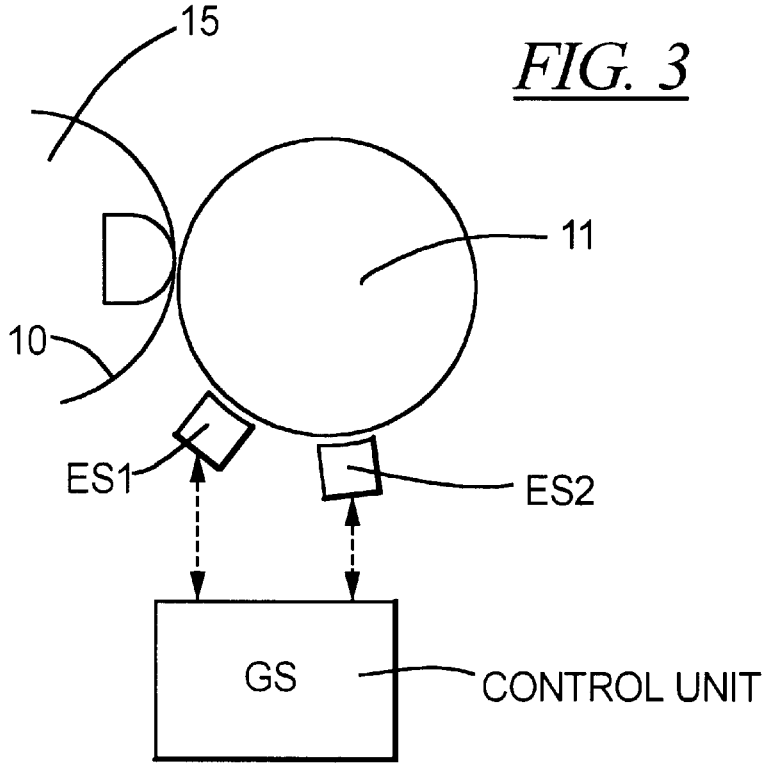
FIG. 3 shows a schematic view of a printer apparatus with two developer stations.

In the embodiment of FIG. 3, the apparatus contains two switchable developer stations ES1 and ES2, which are arranged along a photoconductor drum 11. Both developer stations can be fashioned exchangeably, analogously to the embodiment of FIG. 2. The one developer station ES1 thereby contains magnetic toner and the other developer station ES2 thereby contains non-magnetic toner. An apparatus control unit GS, fashioned analogously to the apparatus control unit of FIG. 1, activates the developer stations ES1 and ES2, e.g. by means of switching on and off of the bias voltage or mechanically, dependent on the mode of operation selected. By means of activation of both developer stations, ES1 and ES2, given corresponding selection of the potential relations of the latent charge images on the photoconductor it is also possible in principle to print the recording medium on one page both with magnetic and also with non-magnetic toner. The toner images thus produced are then transferred to the recording medium 10 in the region of the transfer printing station 15. The other functions specified in connection with the apparatus controlling of FIG. 1, such as e.g. the blocking function for the modes of operation or the identification of the developer station via an identification arrangement in the case of exchangeability, can be applied correspondingly, with modifications if necessary.

Figure 4:
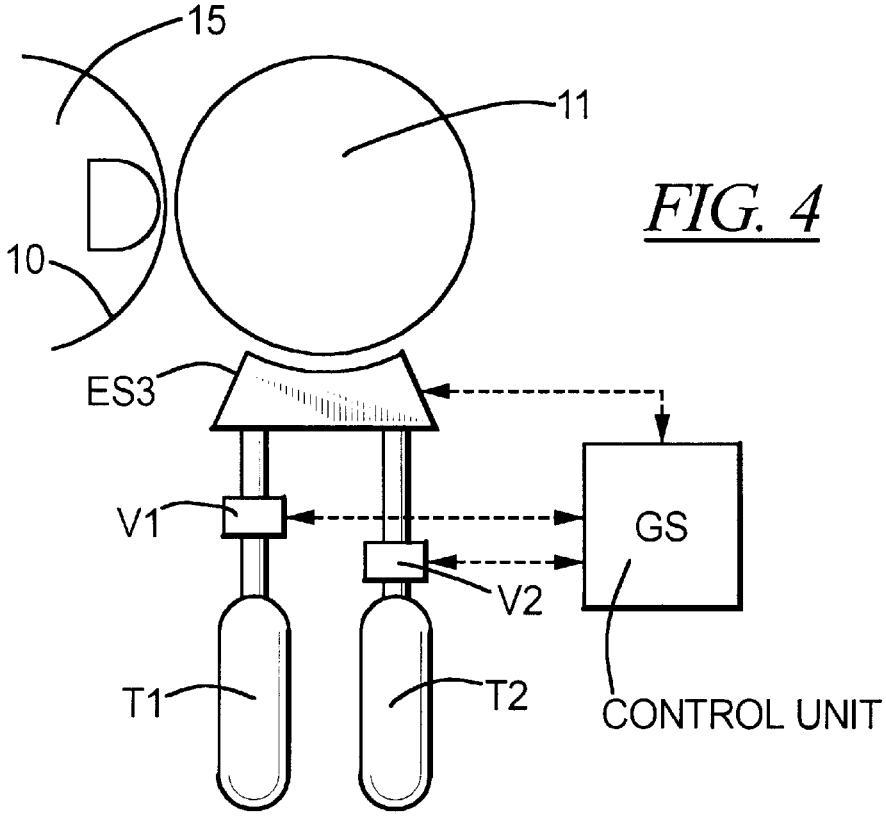
FIG. 4 shows a schematic view of a printer apparatus with a developer station for the alternative supplying of magnetic or non-magnetic toner.

In the embodiment of FIG. 4, the apparatus contains a developer station ES3 with a supplying means for the alternative supplying of magnetic or non-magnetic toner to the developer station ES3, dependent on the mode of operation selected. The supply means contains two toner containers T1 and T2. The toner container T1 thereby contains magnetic toner and the toner container T2 contains non-magnetic toner. Both toner containers are connected with the developer station ES3 via a toner transport system with controllable valves V1 and V2. An apparatus control unit GS, fashioned analogously to the apparatus control unit of FIG. 1, controls the toner supply to the developer station ES3 and the function thereof via the valves V1 and V2, dependent on the mode of operation selected. It must thereby be ensured that the toner types do not become mixed in the developer station ES3. A mixing can be prevented if during the changing of the type of toner the developer station ES3 is completely emptied, e.g. via a partial vacuum means or mechanically. The toner images produced via the developer station ES3 are then transferred to the recording medium 10 in the region of the transfer printing station 15. The other functions specified in connection with the apparatus control unit of FIG. 1, such as, for example, the blocking function for the operational modes or the identification of the developer station via an identification arrangement in the case of exchangeability are correspondingly applicable, with modifications if necessary.

Figure 5:
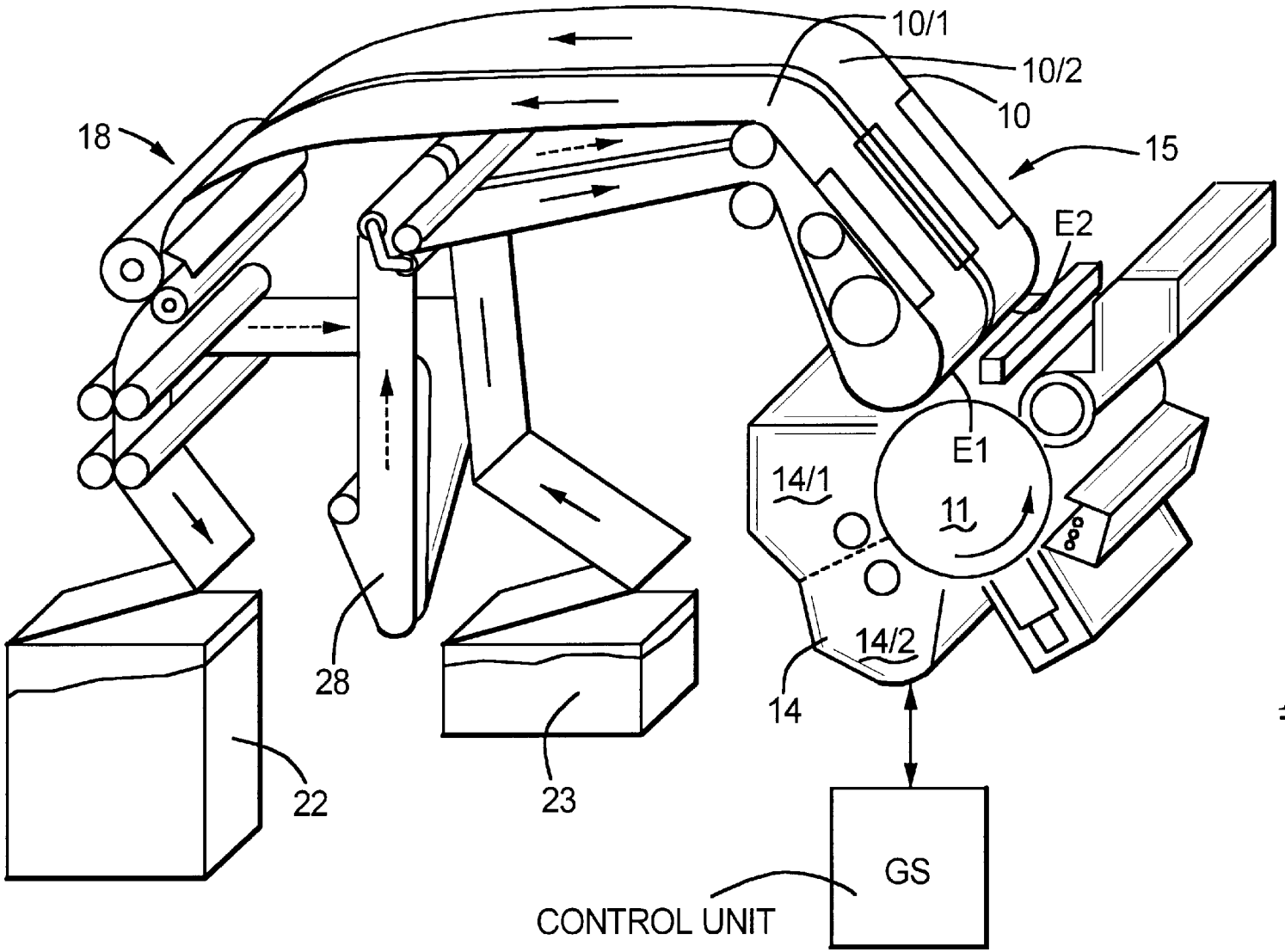
FIG. 5 shows a schematic view of a printer apparatus with a developer station comprising several developer chambers.

Corresponding to the embodiment of FIG. 5, the invention can also be realized in a particularly advantageous manner in a printing means known from U.S. Pat. No. 5,546,178. U.S. Pat. No. 5,546,178 is incorporated herein by reference and is thereby part of the disclosure of this application. The developer station 14 thereby contains two separately controllable and switchable developer chambers 14/1 and 14/2 for the alternative reception of magnetic or non-magnetic toner. For example, the developer chamber 14/1 contains magnetic toner and the developer chamber 14/2 contains non-magnetic toner. A developer zone E1 is allocated to the developer chamber 14/1, and a developer zone E2 is allocated to the developer chamber 14/2. The developer zones E1 and E2 are arranged next to one another in the region of the photoconductor 11, and serve for the tinting of two photoconductor regions of the photoconductor 11. However, instead of two photoconductor regions of a photoconductor 11, the arrangement of two individual photoconductors is also possible, which are for example coupled in terms of their drive. Toner images produced on the photoconductor regions are transfer-printed on recording medium webs 10/1 and 10/2, guided next to one another, of a single recording medium 10 in the region of the transfer printing station 15.

With the printing principle shown in FIG. 5 and specified in more detail in U.S. Pat. No. 5,546,178, the recording medium 10 can be printed twice in the printer by offsetting and turning the recording medium 10, either once on the front side and once on the back side or twice on the front side or, respectively, back side.

For the printing of the front and back side (duplex), the recording medium 10, beginning from a supply stack 23, is first guided to the developer zone E2, where it is printed with non-magnetic toner, e.g. on the front side, in the allocated transfer printing region of the transfer printing station 15. The loose front-side toner image is then fixed in the fixing station 18, and the recording medium 10 is turned in the turning station 28 and is offset, and is subsequently supplied to the transfer printing region of the transfer printing station 15, which region is allocated to the developer zones E2, for the printing of the back side with magnetic toner. The loose back-side toner image is then in turn fixed in the fixing station 18 and is deposited in the stacker 22.

For the double printing of the front side or, respectively, the back side, the recording medium 10 is not turned in the region of the turning station, but is only offset. In this way, one side of a document can be printed at the same time with non-magnetic and with magnetic toner. In this way, it is possible to print flow text with non-magnetic toner and to selectively print MICR-readable areas with magnetic toner, which considerably increases print performance.

The developer chamber of the developer zone that prints the recording medium in the first pass is advantageously filled with magnetic toner. By means of the double passage through the fixing station, after the application of the non-magnetic toner image the magnetic toner image is again fixed together with this non-magnetic toner image, which has an advantageous effect on the fixing quality.

An apparatus control unit GS, fashioned analogously to the apparatus control unit of FIG. 1, controls the developer chambers 14/1 and 14/2 dependent on the mode of operation allocated to them or selected. For the controlling of the specified print sequences, the apparatus control unit GS also contains a print sequence control unit, which can be fashioned corresponding to the control unit specified in U.S. Pat. No. 5,546,178. The other functions specified in connection with the apparatus control unit of FIG. 1, such as e.g. the blocking function for the modes of operation or the identification of the developer station via an identification arrangement in the case of exchangeability, are correspondingly applicable, with modifications if necessary.

In the preceding, the invention has been described on the basis of an electrophotographic print means; however, it can also be used in copier apparatuses. Instead of an electrophotographic process, the use of a magnetographic or an electrostatic process is also possible.

Although other modifications and changes may be suggested by those skilled in the art, it is the intention of the inventor to embody within the patent warranted hereon all changes and modifications as reasonably and properly come within the scope of their contribution to the art.

What is claimed is:

1. A multifunctional printer or copier apparatus with a printer for printing a recording medium with magnetic toner in a first mode of operation or with non-magnetic toner in a second mode of operation in a single apparatus, comprising:

a developer station with a first developer chamber containing magnetic toner and a second developer chamber containing non-magnetic toner, said first and second developer chambers being fashioned as individually switchable developer chambers for production of toner images on one or more photoconductor regions;

a transfer printing station for transfer printing of the toner images on the recording medium, an operational control unit that determines a mode of operation; and a process control unit that is functionally connected with the operational control unit, said process control unit determines setting values of process parameters of sub-aggregates involved in a print process dependent on the set mode of operation; wherein said transfer printing station includes a toner transfer region of sufficient width for at least two recording medium webs to be guided next to one another, and respective ones of said first and second developer chambers being allocated to each of the recording medium webs.

2. A multifunctional printer or copier apparatus with a printer for printing a recording medium with magnetic toner in a first mode of operation or with non-magnetic toner in a second mode of operation in a single apparatus, comprising:

a receiver portion arranged in the apparatus for alternative exchangeable reception of a developer station containing magnetic or non-magnetic toner for the production of toner images on a photoconductor;

a transfer printing station for transfer printing of the toner images on the recording medium, an operational control unit that determines a mode of operation dependent on the developer station located in the receiver portion;

a process control unit connected functionally with the operational control unit, said process control unit determines setting values of process parameters of sub-aggregates involved in a print process dependent on a set mode of operation; and an operator panel having as least one of an input and a display for operating data, said operating data including data determining the modes of operation, said operator panel being functionally connected with the operational control unit.

3. A multifunctional printer or copier apparatus with a printer for printing a recording medium with magnetic toner in a first mode of operation or with non-magnetic toner in a second mode of operation in a single apparatus, comprising:

a receiver portion arranged in the apparatus for alternative exchangeable reception of a developer station containing magnetic or non-magnetic toner for the production of toner images on a photoconductor;

a transfer printing station for transfer printing of the toner images on the recording medium, an operational control unit that determines a mode of operation dependent on the developer station located in the receiver portion;

a process control unit connected functionally with the operational control unit, said process control unit determines setting values of process parameters of sub-aggregates involved in a print process dependent on a set mode of operation; and an identification arrangement for identification of the developer station, said identification arrangement including an identifier element allocated to the developer station, and a scanning for the identifier element, said scanner being allocated to the apparatus and being functionally connected with said operational control unit and said process control unit.

4. A multifunctional printer or copier apparatus with a printer for printing a recording medium with magnetic toner in a first mode of operation or with non-magnetic toner in a second mode of operation in a single apparatus, comprising:

a receiver portion arranged in the apparatus for alternative exchangeable reception of a developer station containing magnetic or non-magnetic toner for the production of toner images on a photoconductor;

a transfer printing station for transfer printing of the toner images on the recording medium, an operational control unit that determines a mode of operation dependent on the developer station located in the receiver portion;

a process control unit connected functionally with the operational control unit, said process control unit determines setting values of process parameters of sub-aggregates involved in a print process dependent on a set mode of operation; and an identification arrangement for identification of the developer station, said identification arrangement including a non-volatile memory allocated to the developer station for storage of operational data, as well as a communication interface for detachable functional connection of the non-volatile memory with said operational control unit and said process control unit.

5. A multifunctional printer or copier apparatus with a printer for printing a recording medium with magnetic toner in a first mode of operation or with non-magnetic toner in a second mode of operation in a single apparatus, comprising:

a receiver portion arranged in the apparatus for alternative exchangeable reception of a developer station containing magnetic or non-magnetic toner for the production of toner images on a photoconductor;

a transfer printing station for transfer printing of the toner images on the recording medium, an operational control unit that determines a mode of operation dependent on the developer station located in the receiver portion;

a process control unit connected functionally with the operational control unit, said process control unit determines setting values of process parameters of sub-aggregates involved in a print process dependent on a set mode of operation; and a memory in which are stored setting values of the process parameters to be set dependent on the modes of operation in the form of tables that can be called.

6. A multifunctional printer or copier apparatus with a printer for printing a recording medium with magnetic toner in a first mode of operation or with non-magnetic toner in a second mode of operation in a single apparatus, comprising:

a receiver portion arranged in the apparatus for alternative exchangeable reception of a developer station containing magnetic or non-magnetic toner for the production of toner images on a photoconductor;

a transfer printing station for transfer printing of the toner images on the recording medium, an operational control unit that determines a mode of operation dependent on the developer station located in the receiver portion;

a process control unit connected functionally with the operational control unit, said process control unit determines setting values of process parameters of sub-aggregates involved in a print process dependent on a set mode of operation; and a blocking means for selective blocking of operating functions.

7. A multifunctional printer or copier apparatus according to claim 6, wherein said blocking means includes:

a memory for modifiable reception of data characterizing a blocked mode of operation, and a testing means which given calling of a mode of operation checks whether a blocked mode of operation is present based on data stored in the memory and which blocks print operation given presence of a blocked mode of operation.

8. A multifunctional printer or copier apparatus with a printer for printing a recording medium with magnetic toner in a first mode of operation or with non-magnetic toner in a second mode of operation in a single apparatus, comprising:

a receiver portion arranged in the apparatus for alternative exchangeable reception of a developer station containing magnetic or non-magnetic toner for the production of toner images on a photoconductor;

a transfer printing station for transfer printing of the toner images on the recording medium;

an operational control unit that determines a mode of operation dependent on the developer station located in the receiver portion;

a process control unit connected functionally with the operational control unit, said process control unit determines setting values of process parameters of sub-aggregates involved in a print process dependent on a set mode of operation; and a counter for acquisition of print volume produced in the individual operational modes.

9. A multifunctional printer or copier apparatus with a printer for printing a recording medium with magnetic toner in a first mode of operation or with non-magnetic toner in a second mode of operation in a single apparatus, comprising:

a first developer station that processes magnetic toner and a second developer station that processes non-magnetic toner, said first and second developer stations being fashioned for production of toner images as individually switchable developer stations and are arranged along a photoconductor;

a transfer printing station for the transfer printing of toner images on the recording medium;

an operational control unit that determines mode of operation;

a process control unit that is functionally connected with the operational control unit, said process control unit determines setting values of process parameters of sub-aggregates involved in the print process dependent on a set mode of operation; and an operator panel having as least one of an input and a display for operating data, said operating data including data determining the modes of operation, said operator panel being functionally connected with the operational control unit.

10. A multifunctional printer or copier apparatus with a printer for printing a recording medium with magnetic toner in a first mode of operation or with non-magnetic toner in a second mode of operation in a single apparatus, comprising:

at least one developer station that accepts magnetic or non-magnetic toner for production of toner images on a photoconductor;

a supply for alternative supplying of magnetic or non-magnetic toner to the developer station dependent on a mode of operation;

a transfer printing station for transfer printing of toner images on the recording medium;

an operational control unit that determines mode of operation;

a process control unit that is functionally connected with the operational control unit, said process control unit determines setting values of process parameters of sub-aggregates involved in the print process dependent on the set mode of operation; and an operator panel having as least one of an input and a display for operating data, said operating data including data determining the modes of operation, said operator panel being functionally connected with the operational control unit.

11. A multifunctional printer or copier apparatus with a printer for printing a recording medium with magnetic toner in a first mode of operation or with non-magnetic toner in a second mode of operation in a single apparatus, comprising:

a developer station with a first developer chamber containing magnetic toner and a second developer chamber containing non-magnetic toner, said first and second developer chambers being fashioned as individually switchable developer chambers for production of toner images on one or more photoconductor regions;

a transfer printing station for transfer printing of the toner images on the recording medium;

an operational control unit that determines a mode of operation;

a process control unit that is functionally connected with the operational control unit, said process control unit determines setting values of process parameters of sub-aggregates involved in a print process dependent on the set mode of operation; and an operator panel having as least one of an input and a display for operating data, said operating data including data determining the modes of operation, said operator panel being functionally connected with the operational control unit.

12. A multifunctional printer or copier apparatus with a printer for printing a recording medium with magnetic toner in a first mode of operation or with non-magnetic toner in a second mode of operation in a single apparatus, comprising:

a first developer station that processes magnetic toner and a second developer station that processes non-magnetic toner, said first and second developer stations being fashioned for production of toner images as individually switchable developer stations and are arranged along a photoconductor;

a transfer printing station for the transfer printing of toner images on the recording medium;

an operational control unit that determines mode of operation;

a process control unit that is functionally connected with the operational control unit, said process control unit determines setting values of process parameters of sub-aggregates involved in the print process dependent on a set mode of operation; and a memory in which are stored setting values of the process parameters to be set dependent on the modes of operation in the form of tables that can be called.

13. A multifunctional printer or copier apparatus with a printer for printing a recording medium with magnetic toner in a first mode of operation or with non-magnetic toner in a second mode of operation in a single apparatus, comprising:

a first developer station that processes magnetic toner and a second developer station that processes non-magnetic toner, said first and second developer stations being fashioned for production of toner images as individually switchable developer stations and are arranged along a photoconductor;

a transfer printing station for the transfer printing of toner images on the recording medium;

an operational control unit that determines mode of operation;

a process control unit that is functionally connected with the operational control unit, said process control unit determines setting values of process parameters of sub-aggregates involved in the print process dependent on a set mode of operation; and a blocking means for selective blocking of operating functions.

14. A multifunctional printer or copier apparatus with a printer for printing a recording medium with magnetic toner in a first mode of operation or with non-magnetic toner in a second mode of operation in a single apparatus, comprising:

a first developer station that processes magnetic toner and a second developer station that processes non-magnetic toner said first and second developer stations being fashioned for production of toner images as individually switchable developer stations and are arranged along a photoconductor;

a transfer printing station for the transfer printing of toner images on the recording medium;

an operational control unit that determines mode of operation;

a process control unit that is functionally connected with the operational control unit, said process control unit determines setting values of process parameters of sub-aggregates involved in the print process dependent on a set mode of operation; and a counter for acquisition of print volume produced in the individual operational modes.

15. A multifunctional printer or copier apparatus with a printer for printing a recording medium with magnetic toner in a first mode of operation or with non-magnetic toner in a second mode of operation in a single apparatus, comprising:

at least one developer station that accepts magnetic or non-magnetic toner for production of toner images on a photoconductor;

a supply for alternative supplying of magnetic or non-magnetic toner to the developer station dependent on a mode of operation;

a transfer printing station for transfer printing of toner images on the recording medium;

an operational control unit that determines mode of operation;

a process control unit that is functionally connected with the operational control unit, said process control unit determines setting values of process parameters of sub-aggregates involved in the print process dependent on the set mode of operation; and a memory in which are stored setting values of the process parameters to be set dependent on the modes of operation in the form of tables that can be called.

16. A multifunctional printer or copier apparatus with a printer for printing a recording medium with magnetic toner in a first mode of operation or with non-magnetic toner in a second mode of operation in a single apparatus, comprising:

at least one developer station that accepts magnetic or non-magnetic toner for production of toner images on a photoconductor;

a supply for alternative supplying of magnetic or non-magnetic toner to the developer station dependent on a mode of operation;

a transfer printing station for transfer printing of toner images on the recording medium;

an operational control unit that determines mode of operation;

a process control unit that is functionally connected with the operational control unit, said process control unit determines setting values of process parameters of sub-aggregates involved in the print process dependent on the set mode of operation; and a blocking means for selective blocking of operating functions.

17. A multifunctional printer or copier apparatus with a printer for printing a recording medium with magnetic toner in a first mode of operation or with non-magnetic toner in a second mode of operation in a single apparatus, comprising:

at least one developer station that accepts magnetic or non-magnetic toner for production of toner images on a photoconductor;

a supply for alternative supplying of magnetic or non-magnetic toner to the developer station dependent on a mode of operation;

a transfer printing station for transfer printing of toner images on the recording medium, an operational control unit that determines mode of operation;

a process control unit that is functionally connected with the operational control unit, said process control unit determines setting values of process parameters of sub-aggregates involved in the print process dependent on the set mode of operation; and a counter for acquisition of print volume produced in the individual operational modes.

18. A multifunctional printer or copier apparatus with a printer for printing a recording medium with magnetic toner in a first mode of operation or with non-magnetic toner in a second mode of operation in a single apparatus, comprising:

a developer station with a first developer chamber containing magnetic toner and a second developer chamber containing non-magnetic toner said first and second developer chambers being fashioned as individually switchable developer chambers for production of toner images on one or more photoconductor regions;

a transfer printing station for transfer printing of the toner images on the recording medium, an operational control unit that determines a mode of operation;

a process control unit that is functionally connected with the operational control unit, said process control unit determines setting values of process parameters of sub-aggregates involved in a print process dependent on the set mode of operation; and a memory in which are stored setting values of the process parameters to be set dependent on the modes of operation in the form of tables that can be called.

19. A multifunctional printer or copier apparatus with a printer for printing a recording medium with magnetic toner in a first mode of operation or with non-magnetic toner in a second mode of operation in a single apparatus, comprising:

a developer station with a first developer chamber containing magnetic toner and a second developer chamber containing non-magnetic toner, said first and second developer chambers being fashioned as individually switchable developer chambers for production of toner images on one or more photoconductor regions;

a transfer printing station for transfer printing of the toner images on the recording medium, an operational control unit that determines a mode of operation;

a process control unit that is functionally connected with the operational control unit, said process control unit determines setting values of process parameters of sub-aggregates involved in a print process dependent on the set mode of operation; and a blocking means for selective blocking of operating functions.

20. A multifunctional printer or copier apparatus with a printer for printing a recording medium with magnetic toner in a first mode of operation or with non-magnetic toner in a second mode of operation in a single apparatus, comprising:

a developer station with a first developer chamber containing magnetic toner and a second developer chamber containing non-magnetic toner, said first and second developer chambers being fashioned as individually switchable developer chambers for production of toner images on one or more photoconductor regions;

a transfer printing station for transfer printing of the toner images on the recording medium, an operational control unit that determines a mode of operation;

a process control unit that is functionally connected with the operational control unit, said process control unit determines setting values of process parameters of sub-aggregates involved in a print process dependent on the set mode of operation; and a counter for acquisition of print volume produced in the individual operational modes.

* * * * *